US006027205A

United States Patent [19]

Herbert

[11] Patent Number: 6,027,205

[45] Date of Patent: Feb. 22, 2000

[54] INK JET PRINTING DEVICE

[75] Inventor: Raymond John Herbert, Essex, United Kingdom

[73] Assignee: Neopost Limited, Essex, United Kingdom

[21] Appl. No.: 08/790,799

[22] Filed: Jan. 30, 1997

[30] Foreign Application Priority Data

Jan. 31, 1996 [GB] United Kingdom ..... 9601947

[51] Int. Cl.[7] ..... B41J 2/14

[52] U.S. Cl. ..... 347/54; 347/20; 347/21; 347/75; 347/85; 222/518; 222/149

[58] Field of Search ..... 347/54, 75, 85, 347/20, 21; 222/518, 149; 239/533.15, 548, 114, 123

[56] References Cited

U.S. PATENT DOCUMENTS

| | | | |
|---|---|---|---|
| 4,325,072 | 4/1982 | Rosel | 346/140.1 |
| 4,555,719 | 11/1985 | Arway et al. | 347/54 |
| 4,576,111 | 3/1986 | Slomianny | 118/313 |
| 4,658,272 | 4/1987 | Toganoh et al. | 347/89 |
| 5,039,997 | 8/1991 | Pullen et al. | 347/54 |

FOREIGN PATENT DOCUMENTS

| | | | |
|---|---|---|---|
| 61-69467 | 4/1986 | Japan | 347/54 |
| 1005326 | 9/1965 | United Kingdom . | |
| 2265860 | 10/1993 | United Kingdom | 347/54 |

OTHER PUBLICATIONS

Patent Abstract of Japan vol. 11, No. 48 (M–561) [2495], Feb. 13, 1987 & JP 61 211047 A (A. Yasutake), Sep. 19, 1986.

Patent Abstract of Japan vol. 6, No. 14 (M–108) [892], Jan. 27, 1982 & JP 56 133174 A (S. Matsui), Oct. 19, 1981.

*Primary Examiner*—John Barlow
*Assistant Examiner*—Christina Annick
*Attorney, Agent, or Firm*—Shoemaker and Mattare, Ltd

[57] ABSTRACT

An ink jet printing device is disclosed in which a bore providing a nozzle for the ejection of droplets of ink is closed by a pin to prevent ejection of ink. The pin is movable into a retracted position in which the pin is withdrawn from the bore to permit ejection of droplets of ink from an ink chamber in communication with said bore. The pin is connected to a piston movable within a chamber. A spring acts on the piston to urge the pin into the bore. Withdrawal of the pin from the bore is effected by pressure of ink acting, against the spring force, on the piston. Ink is supplied selectively under pressure to the ink chamber from an ink supply. Alternatively the piston may be moved by selective application of positive and negative gaseous pressure in the chamber.

5 Claims, 2 Drawing Sheets

INK JET PRINTING DEVICE

BACKGROUND OF THE INVENTION

This invention relates to ink jet print heads in which printing is effected by selective ejection of droplets of ink and in particular to such ink jet print heads constructed utilising nano-technology engineering.

Ink jet print heads are well known and include a nozzle to which ink in a liquid state is fed from an ink reservoir and droplets of the ink are selectively ejected under the control of electrical signals from the nozzle onto an ink receiving surface. Ejection of an ink droplet forms a dot on the ink receiving surface and ejection of the droplets is so controlled as to build up, dot-by-dot, a required printed image on the ink receiving surface. Ejection of ink droplets may be effected by various known means. For example electrical energisation of a diaphragm of piezo-electric material may be utilised to create a pulse of pressure in the ink adjacent the nozzle to cause ejection of a droplet of ink. In an alternative method, heat is applied to the ink to create bubbles in the ink adjacent the nozzle and the resultant increase in pressure ejects a droplet of ink. The nozzle is spaced from the ink receiving surface and the ink droplet is ejected with sufficient velocity to cause it to traverse the space between the nozzle and the ink receiving surface. Generally a print head is provided with a plurality of nozzles arranged in a line and the print head is traversed, in a direction perpendicular to the line of nozzles, across the print receiving surface to enable a line of characters to be printed in dot matrix form on the print receiving surface for each traverse of the print head.

SUMMARY OF THE INVENTION

According to the invention an ink jet printing device includes a bore providing a nozzle for the ejection of droplets of ink; a pin movable between a rest position in which the pin extends into and closes the bore of the nozzle and a retracted position in which the pin is withdrawn from the bore; an ink chamber in communication with said bore; selectively operable ink supply means to supply ink under pressure to said ink chamber.

A multi-nozzle ink jet print head may be formed of a plurality of ink jet printing devices as hereinbefore defined.

BRIEF DESCRIPTION OF THE DRAWING

Embodiments of the invention will now be described by way of example with reference to the drawings in which.

DESCRIPTION OF THE PREFERRED EMBODIMENT

Figure 1:
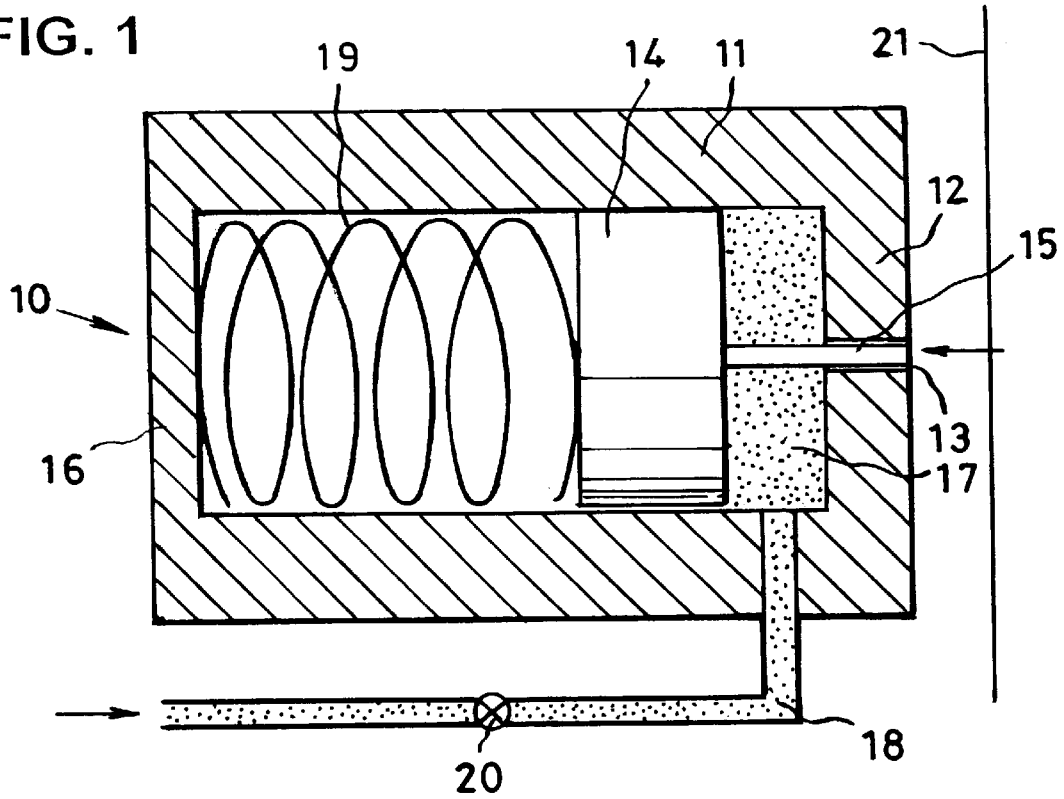
FIG. 1 shows a cross section of one construction of a print head in a non-ejecting state.
Figure 2:
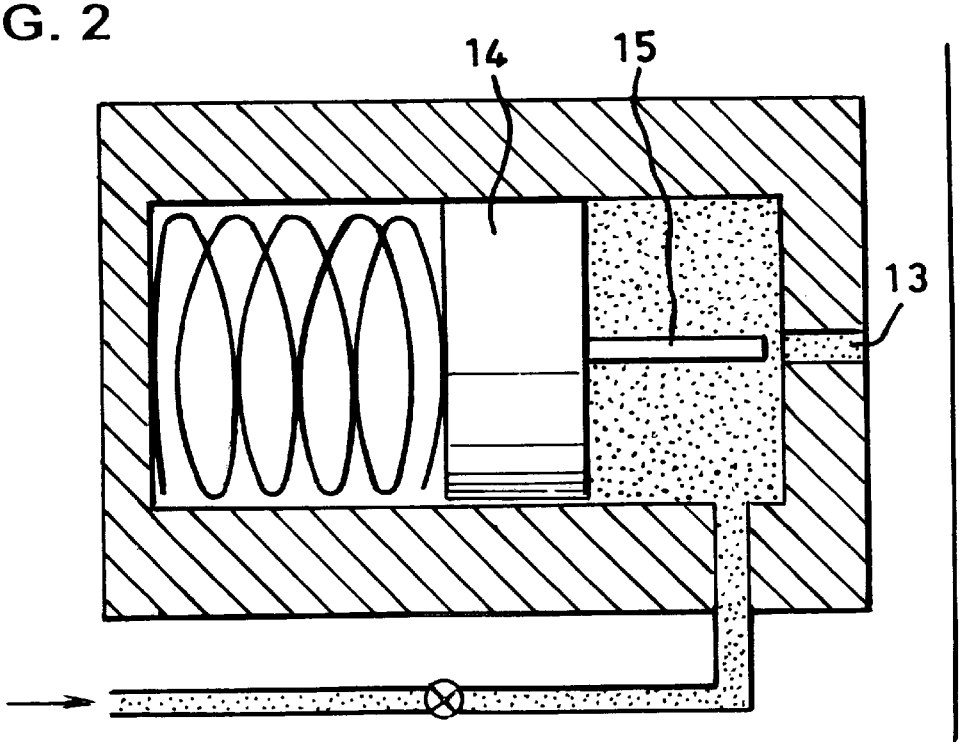
FIG. 2 is similar to FIG. 1 but shows the print head in an ejecting state.

Referring first to FIGS. 1 and 2, an ink ejector 10 of a print head comprises a cylindrical body element 11 preferably of circular cross section. A front end of the cylinder is closed by a front plate 12. The front plate has a central bore 13 extending therethrough to provide a nozzle for ejection of droplets of ink. A piston 14 is located within the cylindrical body element 11 and is a sliding fit within the body element 11. The piston 14 carries a pin 15 located axially relative to the piston. The pin 15 is a sliding fit in the bore 13 of the front plate 12. The rear of the cylindrical body element 11 is closed by a rear plate 16. The piston has rest position, as shown in FIG. 1, in which the pin 15 extends through the bore 13 and the piston is spaced from the front plate 12. A space 17 between the piston and the front plate forms a chamber for ink. Ink is supplied to the chamber 17 by means of a pipe 18 extending through the wall of body element 11. A coil spring 19 is located between the rear of the piston and the rear plate 16 and exerts a force on the piston tending to urge the piston toward the front plate to the non-ejecting rest position illustrated in FIG. 1. Ink is supplied from a reservoir (not shown) to the pipe 18 under pressure and a control valve 20 controls the supply of ink through the pipe to the ink chamber 17. When the control valve 20 is opened, ink is enabled to flow under pressure to the ink chamber and the pressure causes the piston to retract from its rest position against the force of the spring 19 to a position as shown in FIG. 2. The retraction of the piston withdraws the pin from the bore of the nozzle and permits ink to flow into the bore 13 and to be ejected from the bore as a droplet toward an ink receiving surface 21. Upon closure of the control valve 20, flow of ink is terminated and the pressure in the chamber 17 reduces to permit the piston to return to its rest position under the force exerted thereon by the spring 19. Return of the piston to its rest position causes the pin to re-enter the bore in the front plate and thereby displace any ink, including any solid particles of ink which may be present, from the bore. Entry of the pin into the bore assists in ejection of the required ink droplet toward the ink receiving surface 21. If required the space, to the rear of the piston, in which the spring 19 is located may be vented to ambient atmosphere.

Figure 3:
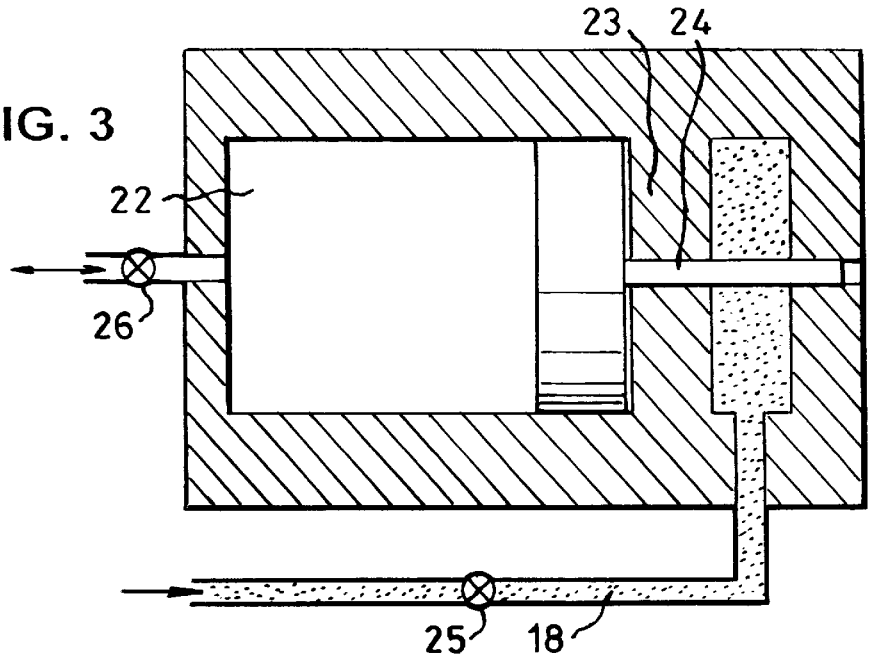
FIG. 3 shows a cross section of an alternative construction of print head.

The construction of ink ejector illustrated by FIG. 3 is similar to that of FIGS. 1 and 2 but, instead of using pressure in the ink to move the piston from its rest non-ejection position, the piston is moved from its rest position to an ink ejecting position by negative pressure in a chamber 22 to the rear of the piston. The piston may be moved to its rest position by means of a spring as in the construction of FIGS. 1 and 2 or by means of positive pressure in the chamber 22. The negative and positive pressures in the chamber 22 may be obtained with the chamber filled with air or other gas or with fluid, means 26 being provided to apply selectively the required pressure, either positive or negative, to the air, gas or fluid as appropriate. In the embodiment illustrated in FIG. 3, an ink chamber communicating with the bore is isolated from the front of the piston by a wall 23. Accordingly pressure in the ink in the chamber does not apply any force to the piston. The wall 23 has a bore 24 extending therethrough and aligned with the bore 13 in the front plate 12. The pin carried by the piston extends through the bore 23, through the ink chamber and through the bore 13. When the piston is retracted from its rest position, the pin is withdrawn from the bore 13 but remains extending through the bore 24. It will be appreciated that, since the ink under pressure in the ink chamber does not act on the piston, the ink in the ink chamber may be continuously under pressure and selective control of the ejection of ink droplets may be solely by the pressure in the rear chamber 22. However if desired, a control valve 25 may be provided in the ink supply pipe 18 to provide more precise control of ink ejection from the nozzle.

Figure 4:
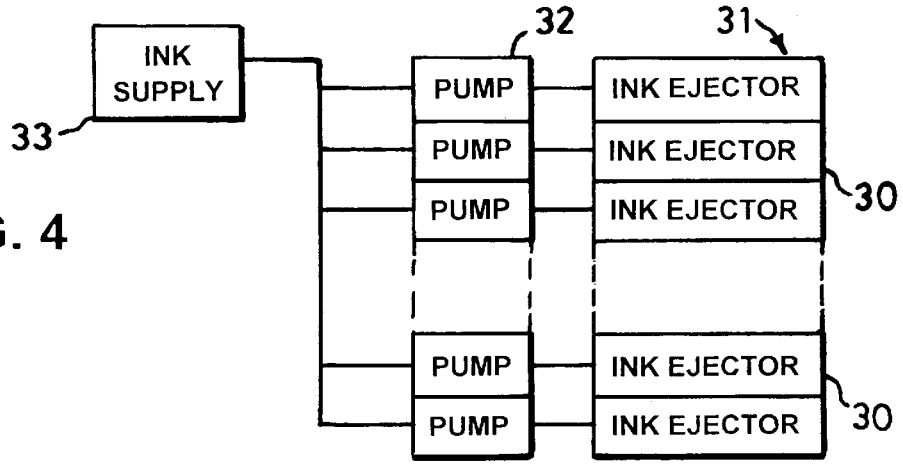
FIG. 4 illustrates a pumped supply of ink to a multi-nozzle print head and, FIG. 5 illustrates a multi-nozzle print head with a control valve for each nozzle.
Figure 5:
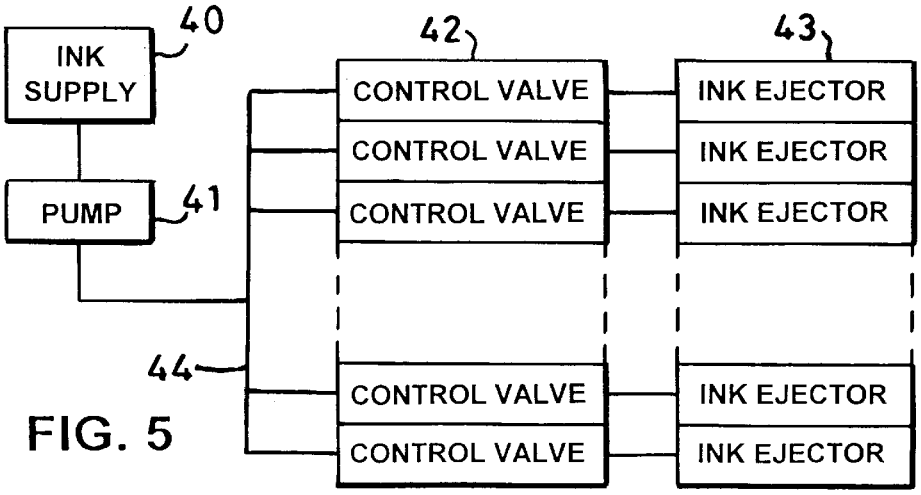

It will be appreciated that an ink jet print head will usually comprise a plurality of ink ejectors to provide a plurality of ejection nozzles and hence a plurality of ink ejectors 30 as described hereinbefore will be provided in a single print head 31 as shown in FIG. 4. It is preferred that individual pumps 32 be provided for each ink ejector 30 to supply ink from an ink supply 33 under pressure to the ink chambers associated with each nozzle respectively. The provision of individual pumps 32 ensures that uniform pressure is applied to each nozzle and that operation of one nozzle does not cause fluctuation in pressure of ink supplied to other nozzles of the print head. Similarly for the ink ejection structure illustrated in FIG. 3 it is preferred to provide individual pumps to supply positive and negative pressure to the rear chambers of the respective ink ejection structures. Thus operation of each ink ejection structure is wholly independent of operation of any other ink ejection structure in the print head. However, if desired a single pump 41 may supply a limited number of ink ejection structures 43 via a common manifold, 44 as illustrated in FIG. 5 provided any pressure fluctuation is within tolerable limits. Ink is supplied from an ink supply 40 by means of a pump 41 to control valves 42. A control valve is provided for each ink ejector 43 and the control valves 42 are selectively actuable to supply ink under pressure from the pump 41 to selected ones of the ink ejectors 43.

It will be appreciated that stop means may be provided to limit the movement of the piston and hence of the pin carried by the piston. The stop means may comprise abutments on the piston or pin or on the wall of the cylindrical body element. The cylindrical body element may be of reduced diameter in the region of the ink chamber thereby limiting movement of the piston toward the front plate 12.

As described above the ink is supplied under constant pressure to the supply pipe, And flow of ink is controlled by means of a control valve 20 (FIG. 1) or 25 (FIG. 3). However if desired, where individual pumps are provided for each respective ink ejector, the pumps may be operated selectively to pump ink to the associated nozzles whenever ejection of an ink droplet from a selected nozzle is required.

A pressure sensor may be provided in the ink chamber and a feedback control circuit responsive to the sensor may then control the rate of rise of pressure in the ink chamber such as to provide optimum ejection of ink droplets from the nozzle. The profile of pressure, i.e. the change of pressure relative to time, may be obtained by control of the operation of the control valves, 20, 25 or 42 control of the operation of the pumps 32 or 41 both depending upon which of these elements controls the ink pressure.

The size of the diameter of the nozzle and of other dimensions of the ink ejection structure will depend upon factors such as the required resolution of the printing effected thereby, the composition of the ink and the application in which the ink ejection structure is to be used. The nozzle diameter could be required to be of the order of a few microns. Also the ink ejection structures either individually or when manufactured as a multi-nozzle print head are required to be relatively small in order to be accommodated within a printing mechanism. Accordingly the components and elements of which the ink ejection structures are manufactured also are relatively small. Therefore it is proposed that the components and elements of the ink ejection structures, the control valves and the pumps be manufactured by nano technology. Such technology permits precision manufacture of components of very small size as is required for the ink ejection structures described hereinbefore.

I claim:

1. An ink jet printing device including:

a body element; said body element including a side wall defining a cylinder chamber within said body element; and an end wall closing an end of said cylinder chamber;

a piston in sealing engagement with said side wall and including an end face opposed to said end wall of said body element; said piston being displaceable in said cylinder chamber between a rest position with said end face adjacent said end wall and an operated position with said end face remote from said end wall;

means acting on said piston and operative to urge said piston toward said end wall into said rest position;

an ink chamber bounded by said side wall and said end wall of said body element and by said end face of said piston;

a bore extending in said body element through said end wall from said ink chamber and comprising a nozzle for ejection of droplets of ink from said ink chamber;

a pin carried by said piston and extending from said end face of said piston; said pin extending into and closing said bore when said piston is in said rest position and said pin being in an operated position retracted from said bore when said piston is displaced to said operated position; and ink supply means connected to said ink chamber and selectively actuable to supply ink to said ink chamber at a determined pressure; said determined pressure of the ink in said ink chamber acting on said end face of said piston to displace said piston from said rest position toward said operated position to retract said pin from said bore and thereby to eject ink from said ink chamber through said bore.

2. An ink jet printing device as claimed in claim 1 wherein the means acting on the piston comprises a spring located in the cylinder chamber and acting between the body element and the piston.

3. An ink jet print head including:

a plurality of ink jet printing devices;

an ink supply and a plurality of selectively actuable actuator means;

each ink jet printing device including:

(a) a body element; said body element including a side wall defining a cylinder chamber within said body element; and an end wall closing an end of said cylinder chamber;

(b) a piston in sealing engagement with said side wall and including an end face opposed to said end wall of said body element; said piston being displaceable in said cylinder chamber between a rest position in which said end face is adjacent said end wall and an operated position in which said end face is remote from said end wall;

(c) means acting on said piston and operative to urge said piston toward said end wall into said rest position; an ink chamber bounded by said side wall and said end wall of said body element and by said end face of said piston;

(d) a bore extending in said body element through said end wall from said ink chamber and comprising a nozzle for ejection of droplets of ink from said ink chamber;

(e) a pin carried by said piston and extending from said end face of said piston; said pin extending into and closing said bore when the piston is in said rest position and said pin being in an operated position retracted from said bore when the piston is in said operated position;

said selectively actuable actuator means connected between said ink supply and ink chambers of respective ink jet printing devices of said plurality of ink jet printing devices to supply ink from said ink supply to selected ones of said ink chambers at a determined pressure; in each said selected ink chamber said determined pressure of the ink in the selected ink chamber acting on said end face of said piston to displace the piston from said rest position toward said operated position to retract the pin from the bore and to eject a droplet of said ink from each selected ink chamber through the nozzle of the bore.

4. An ink jet printing device including a body element defining a cylinder chamber;

a piston in sealing engagement with said body element and displaceable in said cylinder chamber in a displacement direction between a rest position and an operated position;

a bore extending in said displacement direction through said body element from said cylinder chamber to an ink ejection nozzle;

an ink chamber in communication with said bore; ink supply means connected to said ink chamber to supply ink to said ink chamber at a pressure;

a pin carried by said piston and extending in said displacement direction from said piston through said bore; said pin closing said bore between said ink chamber and said ink ejection nozzle thereby preventing ink passing from said ink chamber through said bore to said ink ejection nozzle when the piston is in said rest position and said pin being retracted to permit ink to flow from said ink chamber through said bore to said ink ejection nozzle when the piston is displaced from said rest position; fluid pressure means connected to said cylinder chamber;

and actuator means connected to said cylinder chamber and selectively actuable to control fluid pressure in said cylinder chamber acting on said piston and thereby to displace the piston selectively between said rest and operated positions.

5. An ink jet printing device as claimed in claim 4 wherein the fluid pressure means comprises a source of negative air pressure and wherein the actuator means is actuable to apply said negative air pressure to the piston to displace the piston from the rest position toward the operated position.

* * * * *